US006557653B2

(12) United States Patent
Hauptmann et al.

(10) Patent No.: US 6,557,653 B2
(45) Date of Patent: May 6, 2003

(54) WORKING TOOL FOR A PERCUSSION POWER TOOL

(75) Inventors: Udo Hauptmann, Landsberg a. Lech (DE); Hanspeter Schad, Grabs (CH); Martin Richter, Freising (DE); Franz Popp, Buchloe (DE); Josef Fünfer, Königsbrunn (DE); Konrad Artmann, Wörthsee (DE); Josef Bauer, Landsberg a. Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/902,680

(22) Filed: Jul. 11, 2001

(65) Prior Publication Data

US 2002/0020566 A1 Feb. 21, 2002

(30) Foreign Application Priority Data

Jul. 17, 2000 (DE) ..... 100 34 742

(51) Int. Cl.[7] ..... E21B 6/00
(52) U.S. Cl. ..... 175/305; 175/414; 173/128
(58) Field of Search ..... 175/414, 293, 175/295, 296, 300, 305, 415, 320; 173/128, 133, 210, 211

(56) References Cited

U.S. PATENT DOCUMENTS 1,744,141 A 1/1930 Pryce
3,804,181 A * 4/1974 Curington et al. ..... 173/17
3,833,072 A 9/1974 Back
4,290,489 A * 9/1981 Leavell ..... 173/17
4,303,131 A * 12/1981 Clark ..... 173/134
4,303,133 A * 12/1981 Godolphin ..... 173/134
4,619,334 A 10/1986 Gustafsson
4,732,219 A 3/1988 Chromy
4,790,390 A * 12/1988 Sweeny ..... 173/17
6,021,855 A 2/2000 Beccu

OTHER PUBLICATIONS

EP Search Report (EP 01810684).

* cited by examiner

*Primary Examiner*—Frank Tsay
(74) *Attorney, Agent, or Firm*—Sidley Austin Brown & Wood, LLP

(57) ABSTRACT

A working tool for use with a percussion power tool and including a cushioning elongate stem (3), and a head (4) connected with the stem (3) for joint rotation therewith and for a limited axial displacement relative thereto, with the tool head (4) being adapted, with respect to its resistance associated with its cushioning properties, to characteristics of the percussion piston (5) of the power tool and with the tool stem (3) and the tool head (4) having mutually abutting each other end surfaces (10) which form at least a partially flat contact upon abutting each other.

10 Claims, 5 Drawing Sheets

A-A (A - A)

A-A

WORKING TOOL FOR A PERCUSSION POWER TOOL

BACKGROUND OF THE INVENTION

1. Field of the Invention

The present invention relates to a working tool, such as trepan or chisel, for use with a percussion power tool, such as a hammer drill or a chisel hammer, for treating, preferably, stone, concrete, and brickwork.

2. Description of the Prior Art

A trepan or a boring bit, which is used, e.g., with a hammer drill, is subjected to mechanical impacts applied to its end surface by an anvil and/or percussion piston of e.g., electropneumatic percussion mechanism of the hammer drill. The impact or shock energy propagates, substantially in form of longitudinal pulses, which assume the form of shock pulses, toward the opposite end surface of the bit which transmits the shock energy to the treated material. The removal of the treated material results from the work produced by the transmitted shock energy. The opposite end surface is usually formed as a tool or bit head formed of hard metal or including hard metal work elements.

The physics of pulse transmission discloses how a pulse, upon being transmitted between two abutting each other bodies, is distributed therebetween, i.e., is transmitted from one body to another or is reflected from the other body. A portion of the excited energy, which is transmitted from the working tool to the treated material, depends on the cushioning properties of the bodies located in the pulse transmission chain in accordance with the pulse ratio for bar-shaped bodies determined by the bar theory. The excited energy causes, in the working took, a translational movement of the gravity center, on one hand, and a pivotal movement about the gravity center, on the other hand. However, essentially, only the translational movement of the gravity center is used in the operational process.

U.S. Pat. No. 4,165,790 discloses dividing a working tool in several components connected with each other for joint rotation with each other and for a limited axial movement relative to each other. The tool disclosed in U.S. Pat. No. 4,165,790 consists of a short tool head, a substantially elongate tool stem, and a shank, with the head, stem, and shank being connected by using a hexagonal connection secured with a transverse pin. Such a connection insures a connection that provides for joint rotation of the connected components and for their limited axial displacement relative to each other. U.S. Pat. No. 4,605,079 discloses a tool with a very short tool head having an inner hexagon for a formlocking connection that insures joint rotation of the connected components and their limited axial movement relative to each other. The known tool heads do not have optimal characteristics for pulse transmission.

International publication WO97/08421 discloses a working tool formed of a boring tube or a boring bar at the free end of which a drilling insert is provided, with the tool head itself being formed of arranged along its axial length, head portion and stem portion. The connection, which insures the joint rotation of the two parts, is formed by elements having polygonal cross-sections or by a nose receivable in a recess formed in another part. The tool head is secured to the boring tube or the boring bar for a limited axial displacement relative thereto with a light metal pin or a ring. The transmission of the impact or shock pulses, from the boring tube or bar to the tool head, is effected over substantially flat, pulse transmitting surfaces extending transverse to the tool axis. The pulse transmitting surfaces can be provided between a boring tube and radially outer, inwardly located end surface regions of the tool head, and between the boring bar and radial, axially inwardly located, regions of the sleeve-shaped tool head.

As disclosed in WO97/08421, the ratio of the length of the stem portion to the head portion is selected to be as large as possible, in particular, larger than five, in order to transmit a maximum amount of the pulse energy accumulated in the tool head for treating the processed material. Generally, a certain resistance ratio between the stem portion and the head portion should be provided, though some constructively necessary, small axial variations of absolute values are allowable. A shock pulse, which is transmitted to a head side end surface of the boring tube or bar located in the transitional region between the stem and head portions, and which has a double length of the head, is partially transmitted over the short head portion in the treated material, with another portion of the shock pulse being transmitted as a thrust pulse into the axially movable stem portion in which the pulse energy is stored. With this solution, a thrust shock is transmitted to the treated material. According to the teachings of WO97/08421, with the transmission of a pulse energy of a shock pulse having a pulse length double of the length of the tool head, essentially no recoil pulse is excited in the boring tube or bar. Thus, the pulse energy is almost completely transmitted to the tool head and, thereby, into the treated material. With this solution, the pulse transmission of a thrust pulse into a tool head, which is provided with a stem portion, is optimized, with the tool head being formed as an independent or separate working tool with stem and head portion and suitable for treating a material.

The object of the present invention is to provide a constructively simple and easily produced working tool that would permit to optimize the transmission of pulse energy generated in a percussion power tool with which the working tool is used.

SUMMARY OF THE INVENTION

This and other objects of the present invention, which will become apparent hereinafter, are achieved by providing a working tool including a cushioning elongate stem and a head connected with the stem for joint rotation therewith and for a limited axial displacement relative thereto, with the tool head being adapted, with respect to its resistance associated with its cushioning properties, to characteristics of the percussion piston, and with the tool stem and the tool head having mutually abutting each other end surfaces which form at least a partially flat contact upon abutting each other.

With such an adaptation of the working tool head to the characteristics of the percussion piston and/or the anvil, the shock pulse, which is excited by the percussion piston and/or the anvil and has a pulse length double of the tool head length, is transmitted to the tool head almost completely, without any noticeable backward reflection and, thus, without the loss of pulse energy.

As a result of at least partial substantially flat contact of respective shock-transmitting components, a substantially rectangular shock pulse, which is produced by the percussion piston, is not noticeably widens upon being transmitted to the tool head. As a result, the shock pulse is transmitted, with maintaining its shape to a most possible extent, through the tool stem almost completely to the tool head which is adapted with respect to its cushioning characteristics to the percussion piston.

This almost complete transmission of the pulse energy of the percussion piston and/or the anvil to the tool head, which transmits this pulse energy at least partially to the treated material, leads, with relatively large and heavy, with respect to the percussion piston, working tool, to an increase of the operational capacity in comparison with standard systems from about 25% to about 80%.

It should be noted, however, that a limited axial movement of the tool head, even with a geometry adapted, with respect to its cushioning characteristic to the characteristics of at least the percussion piston, is not sufficient for implementing the teachings of the present invention. This is because for using the teachings and advantages of the present invention, an adequate flat contact is necessary for transmitting a substantially non-deformed rectangular pulse of a certain length. Only under these conditions, an almost complete transmission of the pulse is achieved. According to the teachings of the present invention, under these conditions, the tool head is driven into the treated material with maximum transmittable energy.

The abutting each other end surfaces of the percussion piston, and/or the anvil, the tool stem, and the tool head, which extend transverse to the percussion axis, in order to insure a substantially central impact, with small allowable angular offset of the impacted components, advantageously are formed with an effective camber having a large effective contact radius, so that upon impact, not a point contact corresponding to the Hertzian stress but a flat contact dominates. The effective contact radius $r_{eff}$ is determined based on assigned curvatures $r_1$, $r_2$ of the abutting end surfaces from an equation:

$$\frac{1}{r_{eff}} = \left| \frac{1}{r_1} + \frac{1}{r_2} \right.$$

Advantageously, the assigned curvatures $r_{eff}$, $r_1$, $r_2$ of the abutting end surfaces are oriented in the same way which insures a substantially central impact even with a small angular offset of the impacted components, when flat contact is available. To this end, one of the mutually abutting surfaces has a concave profile while the other of the surfaces has a convex profile.

According to the teaching of the present invention, ideally, a camber should have an infinite contact radius. However, practically obtainable effective radius of more than lm permits to increase the operational capacity, in comparison with an ideal flat contact, by about 25%.

Advantageously, cushioning adaptation of the tool head with respect tot he percussion piston and/or the anvil with respect to the tool head resistance is effected in accordance with an equation:

$$\frac{A_2}{A_1} = \sqrt{\frac{E_1}{E_2} * \frac{P_1}{P_2}}$$

wherein $$\frac{L_2}{L_1} \geq \sqrt{\frac{E_2}{E_1} * \frac{P_1}{P_2}}$$

where ($L_1$, $L_2$) represent length ratios ($A_1$, $A_2$) represent cross-sectional surface ratios ($E_1$, $E_2$) represent respective moduluses of elasticity, and ($P_1$, $P_2$) represent respective thicknesses, with index 2 representing the pulse transmitting body.

When the same materials are used for making the percussion piston, and/or the anvil, the tool stem, and the tool head, they should have substantially the same cross-section. If based on constructive considerations, other dimensions are necessary, in addition to the geometries of the bodies, the materials also need be changed. E.g., the material of the percussion piston, usually steel, can be substituted by a lighter ceramic material or by a carbon fiber material.

The necessary embodiments of the tool head, the percussion piston, and/or the anvil must at least substantially be based on a geometry which need not be very precise and which could include prismatic elements. With deviation of the geometry of about 10%, however, about 25% of the increase in the operational capacity become lost.

The tool itself consists of the tool stem and the tool head connected with the tool stem for joint rotation therewith and for a limited axial displacement relative thereto and provided with a bit(s) formed of a hard material. The tool stem should have a sufficiently long cushioning length, and the tool head should be adapted, with respect to its cushioning characteristics to the piston and/or anvil. As it has already been discussed above, in the advantageous case, when all of the piston, the anvil, the tool stem, and the tool head are formed of the same material, their cross-section also should be substantially the same.

Advantageously, the coupling region of the tool stem, which is adjacent to the tool head, would have a prismatic shape, with the cross-section having advantageously a profile of a regular polygon, e.g., of a hexagon. The tool head is provided, in this case, with a matching prismatic element, whereby a formlocking connection is formed that insures joint rotation of the two parts. The two parts are connected with a pin that extends transverse to the tool axis and through both the tool head and stem. One of the parts is provided with an elongate opening through which the pin extends, which insures a relative axial displacement of the two parts.

Advantageously, the tool stem is formed as a hollow tubular member so that a rinsing fluid can flow through the channel formed in the tool stem. The channel is connected with ventilation openings formed in the shank and the tool head. Advantageously, an annual sealing element is arranged between the tool stem and the tool head with a possibility of a limited axial movement therebetween.

According to a first advantageous embodiment of the present invention, the tool head, the length and cross-section of which are determined taking into consideration the required cushioning properties, is provided with a sleeve-shaped region associated with tool stem and in which the tool stem is received for joint rotation with the tool head with a possibility of a limited axial movement relative thereto. The necessary, at least partially substantially two-dimensional end surface between the tool stem and tool head is realized by an inner annular region having a very large effective radius of curvature. Optionally, a sealing member, which is formed as a radially smaller central portion of the tool stem, is received in the central bore section provided in the tool head and associated with the tool bit(s). This central bore section is connected with at least one ventilation opening which is advantageously offset eccentrically relative to the tool axis, is located outwardly of a groove for removing the cut-off material, and has its mouth lying in the end surface of the tool head adjacent to the tool bit. As a fastening element, a pin extending transverse to the tool axis and passing through both stem and head, is used.

In accordance with a second embodiment of the present invention, the tool head, the length and cross-section of which are determined taking into consideration the required cushioning properties, is provided with a radially small central region with a radially outer tenon, which region or section is received in the tool stem provided with a groove in which the tenon engages. The necessary, at least partially substantially two-dimensional end surface between the tool stem and tool shaft is realized by an inner annular region having a very large effect radius of curvature. Optionally, a sealing member, which is formed as a radially smaller central portion of the tool stem, is received in the central bore section provided in the tool head and associated with the tool bit(s). This central bore section is connected with at least one ventilation opening which is advantageously offset eccentrically relative to the tool axis, is located outwardly of a groove for removing the cut-off material, and has its mouth lying in the end surface of the tool head adjacent to the tool bit. As fastening element, a pin extending transverse to the tool axis and passing through a radial opening formed in the stem and an elongate opening formed in the tenon of the tool head or, according to the third embodiment, an annular spring located in the annular groove formed in the stem and passing through a recess formed in the tenon, is used.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
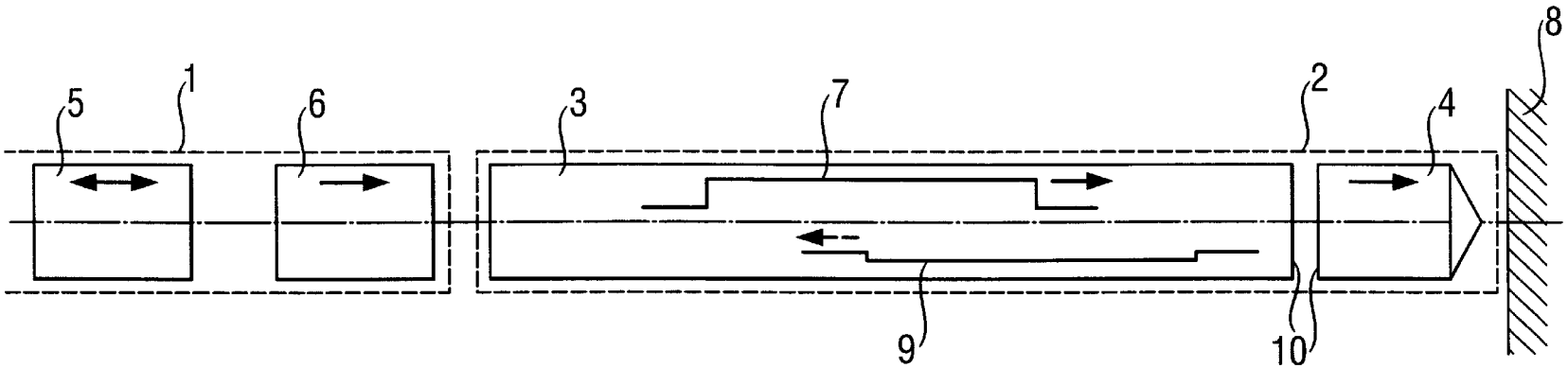
FIG. 1 a schematic view of a working tool for a percussion power tool according to the present invention.

A working tools 2 according to the present invention, which is shown schematically in FIG. 1 and which is associated with a percussion power tool 1 only a portion of which is shown schematically in FIG. 1, has a cushioning elongate tool stem 3 and a tool head 4 capable of a limited axial movement. With respect to its resistance, the tool head 4 is adapted, as far as it concerns its cushioning properties, to a reciprocating percussion piston 5 and anvil 6. The tool head 4 is designed so that it transmits, to a to-be-treated constructional component 8, almost the entire pulse energy of a shock pulse 7, the pulse length of which is equal to a double length of the tool head 4 and which is transmitted by the tool head 4 from the percussion piston 5 via the anvil 6. The transmission of the shock pulse 7 to the constructional component 8 is effected without any noticeable feedback pulse 9 and, thus, without any noticeable loss of the pulse energy during the transmission of the shock pulse 7 to the tool head 4. During the transmission of the shock pulse 7, the impacting each other end surfaces 10 form a flat contact with each other, whereby the shock pulse 7 is essentially transmitted as a rectangular pulse.

Figure 2A:
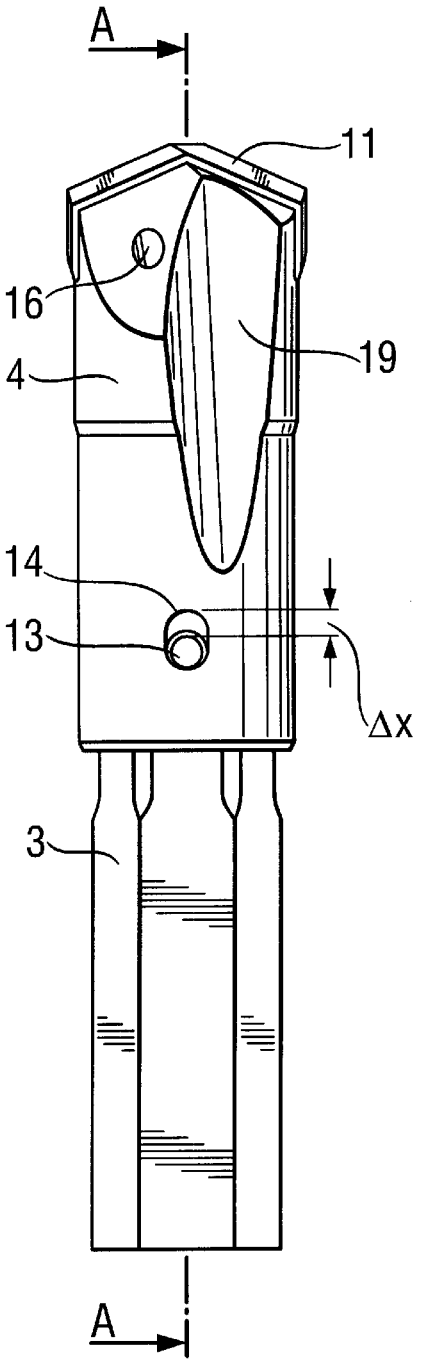
FIG. 2A a perspective view of a working tool for a percussion power tool according to the present invention.
Figure 2B:
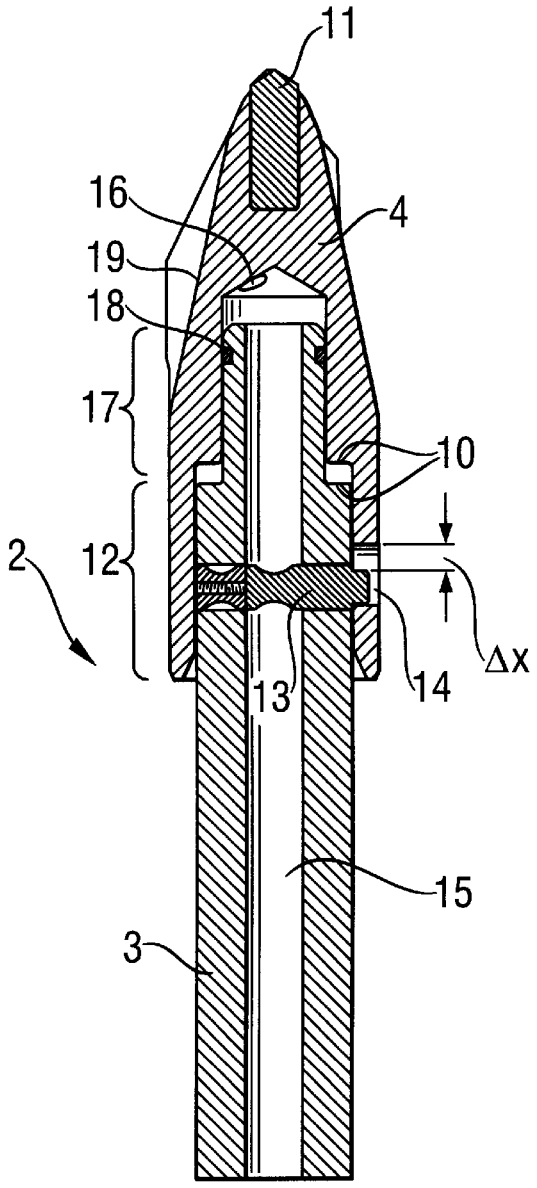
FIG. 2B a longitudinal cross-sectional view of the working tool shown in FIG. 2A along line A—A.

As shown in FIG. 2, the tool head 4, which is connected with the tool stem 3 without a possibility of rotation relative thereto but with a possibility of axial displacement relative thereto, is provided with bits 11 formed of a hard material. In the present case, with both the tool stem 3 and the tool head 4 having a substantially same diameter, the same material is used for forming both the tool stem 3 and the tool head 4. A coupling region 12 of the tool stem 3 adjacent to the tool head 4 has a prismatic shape. The tool head 4 is provided with a matching section corresponding to the adjacent coupling region 12 of the tool stem 3. A pin 13, which extends transverse to the tool axis and passes through both the tool head 4 and the tool stem 3, forms fastening means connecting the tool head 4 and the tool stem 3 with each other. The pin 13 extends through an elongate, extending in the axial direction opening 14, which provides for an easy limited movement $\Delta X$ of the tool head 4 in the axial direction. The associated end surfaces 10 of the tool stem 3 and the tool head 4, which form, at least partially, a flat contact with each other during the transmission of the shock pulse, are formed with an effective camber of more than 1 m. The tool stem 4 is formed as a hollow member. The inner channel 15, which is formed in the stem 3 and ends in a central bore of the tool head 4 in the region of the bits 11, communicates with a ventilation opening 16 formed in the tool head 4. An annular sealing element 18 is provided in an axial sealing region 17 between the tool stem 3 and the tool head 4. The sealing element 18 is arranged in the axial sealing region 17 with a possibility of a limited axial displacement.

Figure 3:
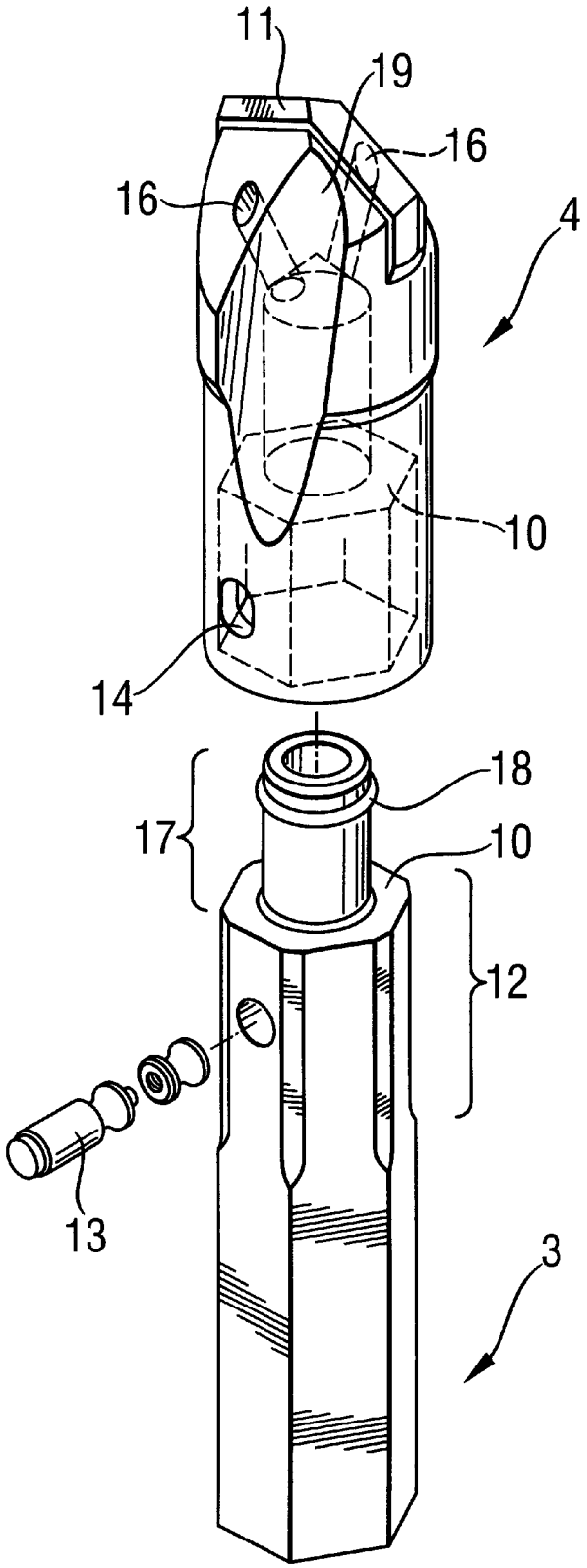
FIG. 3 an exploded view of a first embodiment of a working tool for a percussion power tool according to the present invention.

In the embodiment shown in FIG. 3, the tool head 4, the length and cross-section of which are selected taking into consideration cushioning properties, is formed as a sleeve-shaped member the rear coupling section of which has an inner hexagonal cavity in which the hexagonal prismatic coupling region 12 of the tool stem 3 is received. A substantially flat end surface 10, which cooperates with a corresponding end surface 10 of the tool stem 3, is defined by an inner annular region having a very large effective radius of curvature. The sealing element 18 is arranged about a central sealing region 17 of the tool stem 3 which has a relatively small radial dimension and which engages in the central bore section of the tool head 4 connected with two ventilation openings 16 extending up to respective end surfaces of the tool head 4. The ventilation openings 16 are eccentrically offset with respect to the tool axis and have their mouths arranged in the respective end surfaces of the tool head 4 outwardly of the groove 19 for removing the cut-off material and adjacent to the respective bits 11. The pin 13, which connects the tool head 4 with the tool stem 3, extends through an axial opening or slot 14 formed in the connection section of the sleeve-shaped tool head 4 and through a respective radial hole formed in the tool stem 3.

Figure 4:
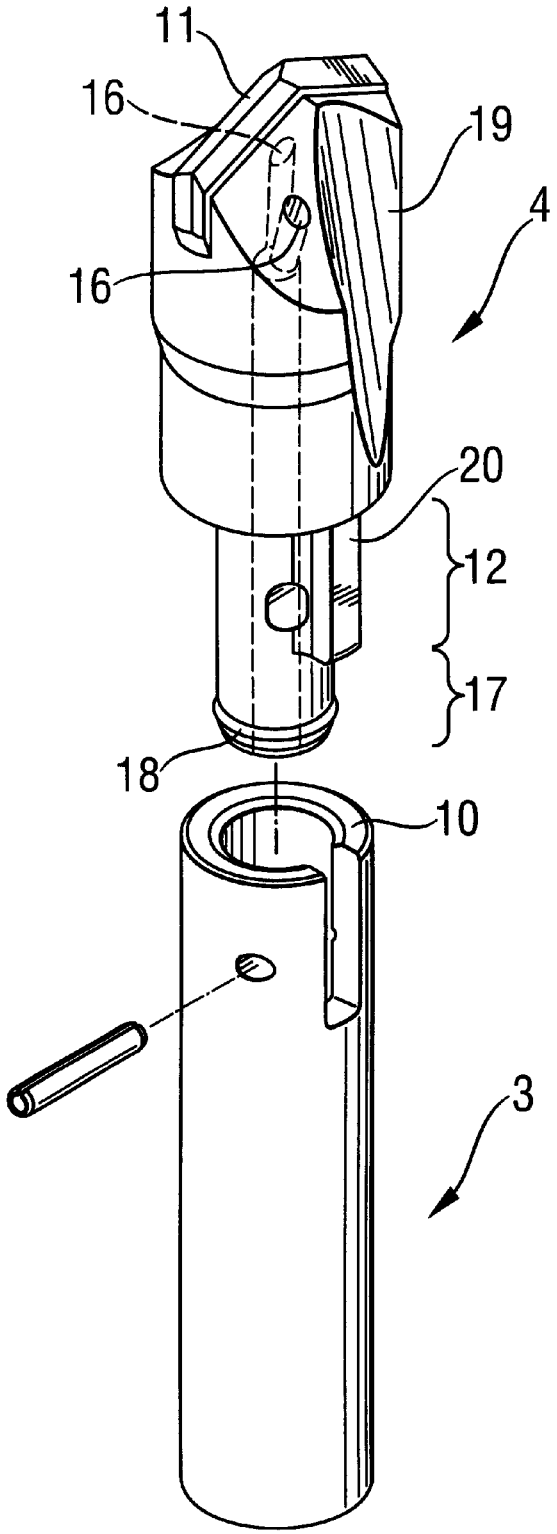
FIG. 4 an exploded view of a second embodiment of a working tool for a percussion power tool according to the present invention.

In the embodiment of the working tool according to the present invention which is shown in FIG. 4, the tool head 4, the length and cross-section of which is selected taking into consideration cushioning properties, has a rear, with a small radial dimension, central coupling section 12 provided with radially outer tenon 20 which is received in a corresponding groove formed in the tool stem 3. The substantially flat cooperating end surface means 10 between the tool stem 3 and the tool head 4 is defined by an annular outer region having a very large radius of curvature. The sealing element 18 is mounted on a central sealing region 17 adjoining the coupling section 12 which is received in a bore formed in the tool stem 3. A central bore, which is formed in the tool head 4, extends through both the sealing region 17 and the coupling section 12, and ends in a bore section located in th region of a bit 11, is connected with two ventilation openings 16 having their mouths opening at respective end surfaces of the tool head 4 outwardly of the groove 19 for removing the cut-off material and adjacent to the bit 11. The tool stem 3 and the tool head 4 are connected with a pin extending through a hole formed in the tool stem 3 and through an elongate slot formed in the tenon 20.

Figure 5:
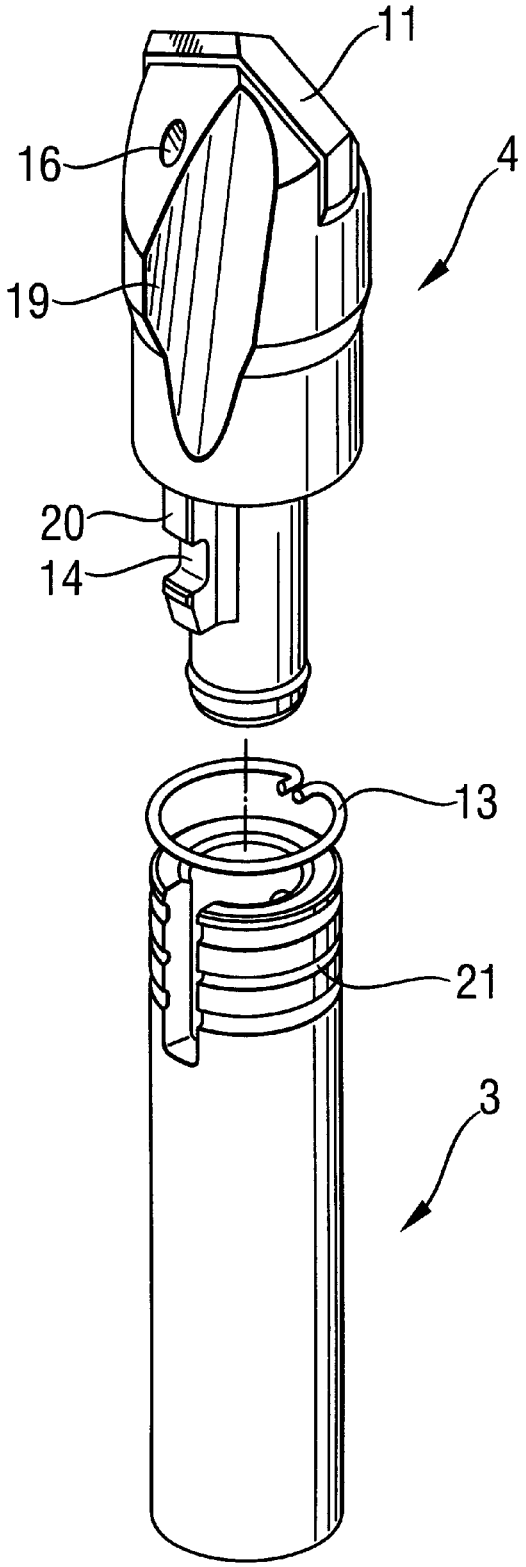
FIG. 5 an exploded view of a third embodiment of a working tool for a percussion power tool according to the present invention.

The embodiment of the tool according to the present invention, which is shown in FIG. 5, differs from that of FIG. 4 in that the fastening means 13 is formed as an annular spring that engages in a radially outer recess 14 formed in the tenon 20 of the tool head 4.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A working tool for use with a percussion power tool having a percussion piston (5) and an anvil (6) that transmits shock pulses from the piston to the working tool, the working tool comprising a cushioning elongate stem (3); and a head (4) connected with the stem (3) for joint rotation therewith and for a limited axial displacement relative thereto, the tool stem (3) and the tool head (4) having mutually abutting each other end surfaces (10) which form at least a partially flat contact upon abutting each other, whereby shock pulses, which are produced by the percussion piston (5), are transmitted by the stem (3) to the head (4), and wherein the head (4) is dimensioned in accordance with dimensions of at least one of the percussion piston (5) and the anvil (6), whereby the shock pulses, which are produced by the percussion piston (5), are transmitted to the head (4) substantially without loss of pulse energy.

2. A working tool according to claim 1, wherein the tool head (4) has a cushioning length which amounts to a half of a length of a shock pulse (7) generated by the at least one of the percussion piston (5) and the anvil (6).

3. A working tool according to claim 1, wherein the tool head (4) and the tool stem (3) have cooperating means for (12) connecting the tool head (4) with the tool stem (3) for joint rotation therewith and having a polygon cross-section.

4. A working tool according to claim 3, further comprising fastening means (13) arranged in the connecting means (12) and extending transverse to a working tool axis and through both the tool head (4) and the tool stem (3) for connecting the tool head (4) and the tool stem (3) with each other, the fastening means extending through elongate receiving means (14) extending in an axial direction and provided in one of the tool head (4) and the tool stem (3).

5. A working tool according to claim 4, wherein the fastening means is formed as one of a pin and a ring.

6. A working tool according to claim 1, wherein the tool stem (3) has a central channel which communicates with ventilation opening means (16) formed in the tool head (4), and wherein the working tool further comprises a sealing element (18) arranged between the tool head (4) and the tool stem (4) with a possibility of a limited axial displacement therebetween.

7. A working tool according to claim 1, wherein the percussion piston (5) is formed of a material which is at least one of lighter than steel and less rigid than steel, and wherein the tool head (4) is adapted to characteristic of the material of the percussion piston.

8. A working tool according to claim 1, wherein the mutually abutting each other end surfaces (10) of the tool head (4) and the tool stem (3) extend transverse to a working tool axis and have an effective camber having an effective contact radius of at least 1 m.

9. A working tool according to claim 8, wherein one of the end surfaces (10) is formed concave and another of the end surfaces (10) is formed convex.

10. A working tool according to claim 1, wherein dimensioning of the tool head (4) in accordance with the dimensions of the at least one of the percussion piston (5) and the anvil (6) is effected by dimensioning of an essential length and an essential cross-section of the working head (4) in accordance with equations:

$$\frac{A_2}{A_1} = \sqrt{\frac{E_1}{E_2} * \frac{P_1}{P_2}}$$

$$\frac{L_2}{L_1} \geq \sqrt{\frac{E_2}{E_1} * \frac{P_1}{P_2}}$$

where $(L_1, L_2)$ represent length ratios, $(A_1, A_2)$ represent cross-sectional surface ratios, $(E_1, E_2)$ represent respective moduluses of elasticity, and $(P_1, P_2)$ represent respective thicknesses, with index 2 representing pulse transmitting body.

* * * * *